US008511137B2

(12) United States Patent
Weaver et al.

(10) Patent No.: US 8,511,137 B2
(45) Date of Patent: Aug. 20, 2013

(54) APPLICATOR RAM HAVING A RAM ADAPTOR

(75) Inventors: Brian Keith Weaver, Harrisburg, PA (US); Kerry Joseph Stakem, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 310 days.

(21) Appl. No.: 12/912,525

(22) Filed: Oct. 26, 2010

(65) Prior Publication Data

US 2012/0096916 A1 Apr. 26, 2012

(51) Int. Cl.
*H01R 43/04* (2006.01)

(52) U.S. Cl.
USPC ..... 72/441; 29/753; 29/761; 29/863; 72/481.1; 72/481.3; 72/481.4; 72/481.5; 72/481.6; 72/482.91; 72/712

(58) Field of Classification Search
USPC ..... 29/753, 761, 863; 72/444, 481.1, 72/481.3–481.6, 482.91, 712
See application file for complete search history.

(56) References Cited

U.S. PATENT DOCUMENTS 5,074,033 A * 12/1991 Dassance et al. ..... 29/753
5,937,510 A * 8/1999 Seiersen et al. ..... 29/753
6,026,562 A * 2/2000 McMillin et al. ..... 29/748
6,367,148 B1 * 4/2002 Caveney et al. ..... 29/753
6,530,257 B2 * 3/2003 Ooji et al. ..... 72/420
7,624,613 B2 * 12/2009 Yu et al. ..... 72/402
2002/0197123 A1 * 12/2002 Kopras et al. ..... 409/182
2007/0101799 A1 * 5/2007 College ..... 72/446
2008/0168653 A1 * 7/2008 Chikyu ..... 29/863
2008/0172864 A1 * 7/2008 Yagi et al. ..... 29/753

FOREIGN PATENT DOCUMENTS

JP 2007 258032 A 10/2007

OTHER PUBLICATIONS

International Search Report, International Application No. PCT/US2011/001764, International Filing Date, Oct. 17, 2011.

* cited by examiner

*Primary Examiner* — Dana Ross
*Assistant Examiner* — Onekki Jolly

(57) ABSTRACT

An applicator ram includes a ram body configured to hold crimp tooling, and a ram adaptor coupled to the ram body. The ram adaptor is configured to be coupled to a terminator ram. The ram adaptor includes an adaptor hub having a hub chamber configured to receive a ram post of the terminator ram. A latch mechanism is movably received in the hub chamber. The latch mechanism is movable between a latched position and an unlatched position. The latch mechanism is configured to engage the ram post in the latched position. The latch mechanism allows the ram post to be released from the hub chamber in the unlatched position. An adaptor stud extends from the adaptor hub and is configured to be coupled to the applicator ram.

20 Claims, 4 Drawing Sheets

APPLICATOR RAM HAVING A RAM ADAPTOR

BACKGROUND OF THE INVENTION

The subject matter herein relates generally to wire termination machines.

Termination machines are known for terminating terminals to wires, such as by a crimping process. The termination machines include a motor that drives a terminator ram along a termination stroke. The terminator ram is connected to an applicator ram and drives the applicator ram along a crimp stroke. The applicator ram holds crimp tooling and drives the crimp tooling along the crimp stroke to terminate the terminal to the wire.

Known termination machines are not without disadvantages. For instance, the connection between the applicator ram and the terminator ram may be difficult and time consuming to achieve. Typically, the connection is what is referred to as a fixed hook style connection in which an end of the applicator ram has a hook or channel formed in the top. The end of the terminator ram is loaded into the channel from the side and slid into position. The channel has tight tolerances to maintain a fixed joint between the applicator ram and the terminator ram, and thus it may be difficult to feed the end of the terminator ram into the channel. Additionally, the space between the terminator and the applicator may be limited, and placement of crimp height adjustment dials may be restricted. The dials tend to be small, making it difficult to see the dials and making fine adjustments difficult.

A need remains for a connection device for connecting applicator rams and terminator rams quickly and easily. A need remains for a more visible and practical fine wire crimp height adjustment.

BRIEF DESCRIPTION OF THE INVENTION

In one embodiment, an applicator ram is provided having a ram body configured to hold crimp tooling, and a ram adaptor coupled to the ram body. The ram adaptor is configured to be coupled to a terminator ram. The ram adaptor includes an adaptor hub having a hub chamber configured to receive a ram post of the terminator ram. A latch mechanism is movably received in the hub chamber. The latch mechanism is movable between a latched position and an unlatched position. The latch mechanism is configured to engage the ram post in the latched position. The latch mechanism allows the ram post to be released from the hub chamber in the unlatched position. An adaptor stud extends from the adaptor hub and is configured to be coupled to the applicator ram.

In another embodiment, an applicator ram is provided having a ram body that holds a crimp tool. The applicator ram also includes a ram adaptor coupled to the ram body that has a spring loaded latch mechanism configured to lock onto a terminator ram post. The latch mechanism is movable between a latched position and an unlatched position. The latch mechanism is configured to engage the terminator ram post in the latched position. The latch mechanism allows the terminator ram post to be released in the unlatched position.

In a further embodiment, an applicator is provided having an anvil positioned within a crimping zone. The applicator also includes an applicator body that has a ram chamber. The applicator body is positioned proximate to the crimping zone. An applicator ram is movably received in the ram chamber. The applicator ram is driven in the ram chamber by a terminator ram during a crimp stroke. The applicator ram has crimp tooling coupled thereto and is driven by the applicator ram along the crimp stroke within the crimping zone toward and away from the anvil. The applicator ram has an adaptor bore that extends into the applicator ram. A ram adaptor is coupled to the applicator ram and is releasably coupled to the terminator ram. The ram adaptor includes an adaptor stud received in the adaptor bore and coupled to the applicator ram. The ram adaptor includes an adaptor hub coupled to the ram stud. The ram adaptor includes a spring loaded latch mechanism received in the adaptor hub and being configured to lock onto a terminator ram post. The latch mechanism is movable between a latched position and an unlatched position, where the latch mechanism engages the terminator ram post in the latched position and allows the terminator ram post to be released in the unlatched position.

DETAILED DESCRIPTION OF THE INVENTION

Figure 1:
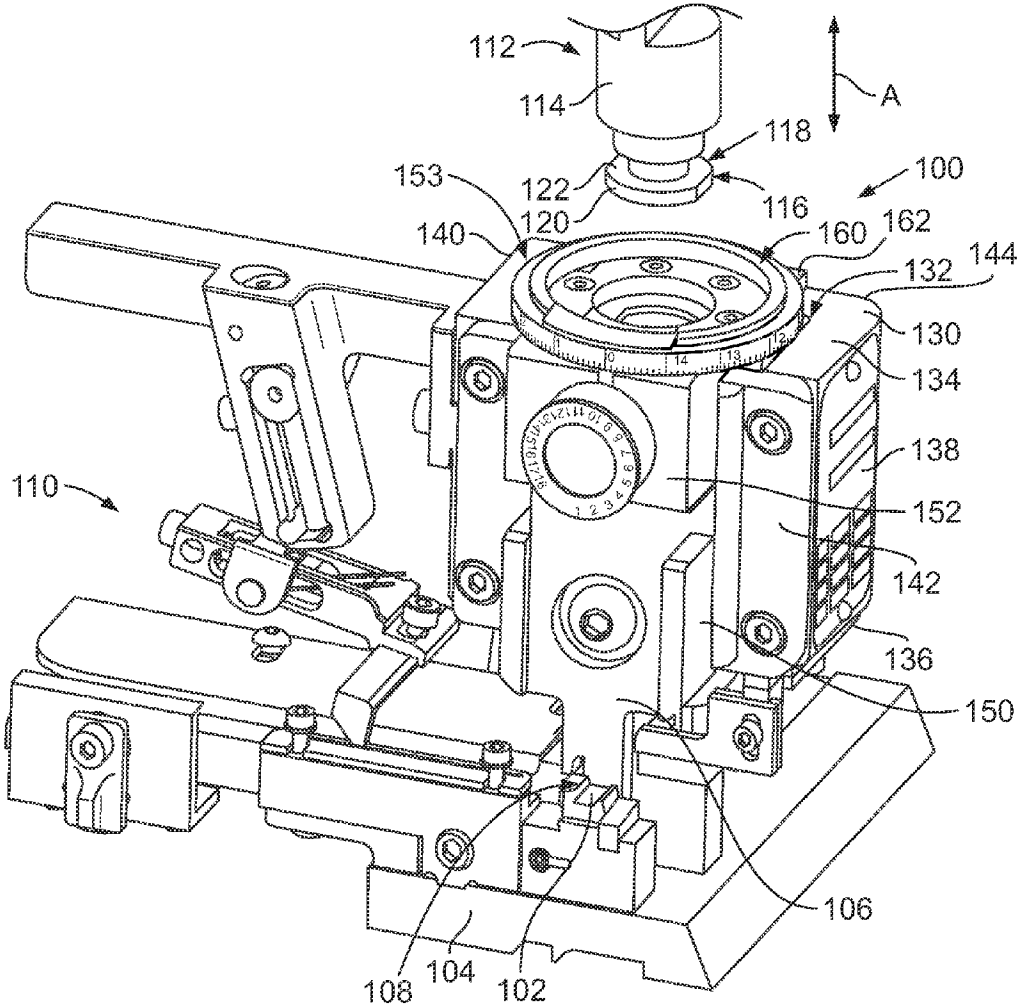
FIG. 1 is a front perspective view of an applicator formed in accordance with an exemplary embodiment.

FIG. 1 is a front perspective view of an applicator 100 formed in accordance with an exemplary embodiment. The applicator 100 is used for crimping terminals to ends of wires. The applicator 100 includes an anvil 102 that is fixed in position on a base 104 that supports the applicator 100. The applicator 100 includes crimp tooling 106 that is driven along a crimp stroke toward and away from the anvil 102 to crimp the terminal to the wire. A crimp zone 108 is defined between the anvil 102 and the crimp tooling 106. The terminal is crimped to the wire within the crimp zone 108. In an exemplary embodiment, the applicator 100 includes a feeder 110 that feeds the terminals to the crimp zone 108 during the crimping process.

In an exemplary embodiment, the applicator 100 is configured to be coupled to a terminator ram 112 of a terminator or termination machine (not shown). The terminator ram 112 is driven through a termination stroke by the terminator. During the termination stroke, the terminator ram 112 is driven along a linear path in a vertical direction, shown by the arrow A. The terminator ram 112 is illustrated in an uncoupled position in FIG. 1. The terminator ram 112 includes a ram post 114 that is configured to be coupled to the applicator 100. The ram post 114 has an end portion 116 that is received in the applicator 100. The ram post 114 includes a post cavity 118 defined by a circumferential groove formed in the end portion 116 of the ram post 114. A flange 120 is provided below the post cavity 118. The flange 120 has an upward facing shoulder 122 that defines a bottom of the post cavity 118. As described in further detail, a portion of the applicator 100 is received in the post cavity 118 to secure the applicator 100 to the terminator ram 112.

The applicator 100 includes an applicator body 130 having a ram chamber 132 therein. The applicator body 130 has a top 134 and a bottom 136. The ram chamber 132 extends between the top 134 and the bottom 136. The applicator body 130 includes a first side 138 and a second side 140. The feeder 110 is provided at the second side 140 and feeds the terminals in a feeding direction generally from the second side 140 to the first side 138. The applicator body 130 has a front 142 and a rear 144. In the illustrated embodiment, the front 142 is open to the ram chamber 132.

An applicator ram 150 is received in the ram chamber 132. The applicator ram 150 is configured to be coupled the terminator ram 112, as described in more detail below. The applicator ram 150 is movable within the ram chamber 132 along a crimp stroke by the terminator ram 112. The applicator ram 150 is movable in a linear direction along a vertical path, in the direction of arrow A. The applicator ram 150 is raised and lowered within the ram chamber 132 during the crimp stroke. The crimp tooling 106 is coupled to a side 152 of the applicator ram 150.

During operation, as the applicator ram 150 is moved through the crimp stroke, the applicator ram 150 raises and lowers the crimp tooling 106 along the crimp stroke within the crimp zone 108. As the crimp tooling 106 is pressed downward toward the anvil 102, the terminal may be terminated to the wire. As the crimp tooling 106 is raised away from the anvil 102, the terminal may be released from the crimp tooling 106 and/or the anvil 102 and replaced with another terminal and wire.

In an exemplary embodiment, the applicator ram 150 includes a crimp height adjustment mechanism 153 for adjusting the vertical position of the applicator ram 150 with respect to the applicator body 130, which also controls the vertical position of the crimp tooling 106 with respect to the stationery anvil 102. For example, raising the applicator ram 150 with respect to the applicator body 130 raises the crimp tooling 106 with respect to the anvil 102. Conversely, lowering the applicator ram 150 with respect to the applicator body 130 lowers the crimp tooling 106 with respect to the anvil 102, thus affecting the crimp height for the terminal. In the illustrated embodiment, the crimp height adjustment mechanism 153 constitutes a dial that may be rotated to change the position of the applicator ram 150.

The applicator ram 150 includes a ram adaptor 160 coupled to a top 162 of the applicator ram 150. The ram adaptor 160 is configured to be releasably coupled to the end portion 116 of the ram post 114. In an exemplary embodiment, the ram adaptor 160 defines a quick connect/quick disconnect connector between the applicator ram 150 and the terminator ram 112. The ram adaptor 160 is spring loaded and may be quickly latched to, and unlatched from, the ram post 114. In an exemplary embodiment, the ram adaptor 160 defines a jam style connector that allows the terminator ram 112 to be plugged directly into the applicator ram 150 by pressing or jamming the ram post 114 into the ram adaptor 160 or pressing or jamming the ram adaptor 160 onto the ram post 114. The ram adaptor 160 is configured to be latched to the terminator ram 112 and may be quickly and easily released from the terminator ram 112, as described in further detail below.

Figure 2:
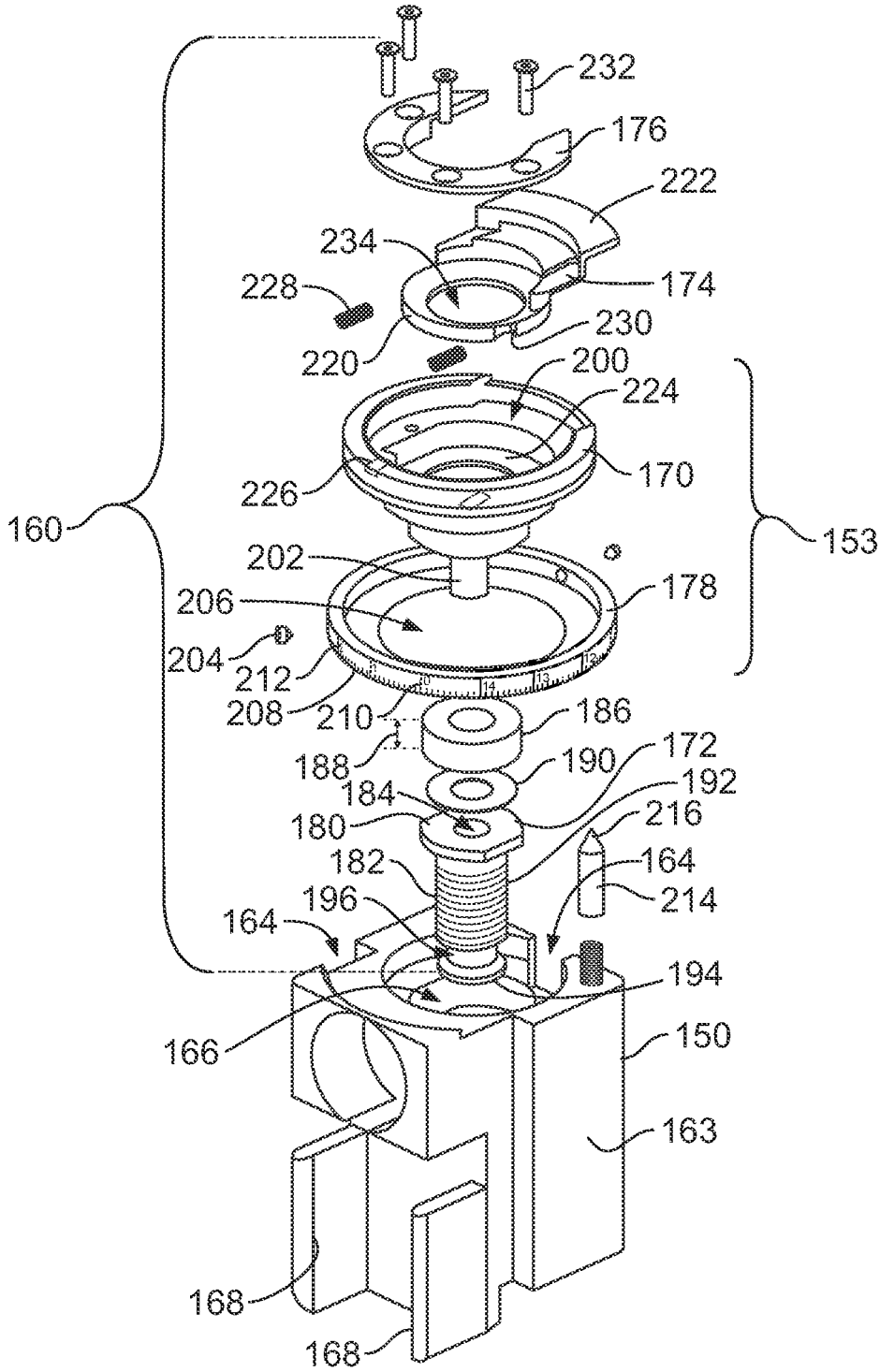
FIG. 2 is an exploded view of a portion of the applicator shown in FIG. 1, illustrating an applicator ram and a ram adaptor configured to be coupled to the applicator ram.

FIG. 2 is an exploded view of the applicator ram 150 and ram adaptor 160. The applicator ram 150 has a generally block-shaped ram body 163 with grooves 164 formed therein. The grooves 164 help orient the applicator ram 150 within the ram chamber 132 (shown in FIG. 1). The grooves 164 may slide along rails (not shown) in the ram chamber 132 to keep the applicator ram 150 in a proper orientation with respect to the applicator body 130 (shown in FIG. 1).

The applicator ram 150 has an adaptor bore 166 extending into the applicator ram 150 from the top 162. Optionally, the adaptor bore 166 may extend entirely through the applicator ram 150. The ram adaptor 160 is configured to be received in the adaptor bore 166. In an exemplary embodiment, the adaptor bore 166 is threaded and the ram adaptor 160 is threadably coupled to the applicator ram 150 within the adaptor bore 166. The ram adaptor 160 may be secured to the applicator ram 150 by alternative means using alternative securing features or processes in alternative embodiments.

In the illustrated embodiment, the applicator ram 150 includes tabs 168 extending from one of the sides of the ram body 163. The tabs 168 define a receiving space therebetween that receives that crimp tooling 106 (shown in FIG. 1). The ram body 163 holds the crimp tooling 106 within the receiving space.

The ram adaptor 160 includes an adaptor hub 170 and an adaptor stud 172 configured to be coupled to the adaptor hub 170. The adaptor stud 172 may be integrally formed with the adaptor hub 170 in an alternative embodiment. A latch mechanism 174 is coupled to the adaptor hub 170 using a latch retainer 176. A calibration device 178 is coupled to the adaptor hub 170 for controlling a relative position of the adaptor hub 170 with respect to the applicator ram 150, as described in further detail below. The calibration device 178 may be integrally formed with the adaptor hub 170 in an alternative embodiment.

The adaptor stud 172 includes a head 180 and a shaft 182 extending from the head 180. In the illustrated embodiment, the shaft 182 is threaded such that the adaptor stud 172 may be threadably coupled to the applicator ram 150 within the adaptor bore 166. The adaptor stud 172 includes an internal bore 184 extending into the head 180 and/or the shaft 182. The internal bore 184 is configured to receive a portion of the adaptor hub 170 to couple the adaptor hub 170 to the adaptor stud 172. Optionally, the internal bore 184 may be threaded. Alternatively, the internal bore 184 may include crush ribs or other features to create an interference fit with the adaptor hub 170 to secure the adaptor hub 170 to the adaptor stud 172.

In an exemplary embodiment, a height adjustment washer 186 may be provided between the adaptor hub 170 and the adaptor stud 172. The height adjustment washer 186 has a thickness or height 188. The height adjustment washer 186 controls the relative position between the adaptor hub 170 and the adaptor stud 172. In an exemplary embodiment, a family of height adjustment washers 186 may be provided, with each member of the family having a different height 188. One of the family members may be selected and positioned between the adaptor hub 170 and the adaptor stud 172. Depending on the height 188 of the height adjustment washer 186, the position of the adaptor hub 170 with respect to the adaptor stud 172 may be adjusted. Such adjustment controls the position of the applicator ram 150 with respect to the terminator ram 112 (shown in FIG. 1). Another washer 190, such as a laminated washer, may be provided between the height adjustment washer 186 and the head 180 of the adaptor stud 172. While the height adjustment washer 186 controls a general position of the adaptor hub 170 with respect to the applicator ram 150, the crimp height adjustment mechanism 153, namely the calibration device 178 controls fine adjustments of the adaptor hub 170 with respect to the applicator ram 150. The height adjustment washers 186 define course height adjustment features, while the calibration device 178 defines a fine height adjustment feature.

In an exemplary embodiment, the shaft 182 includes a plurality of upper threads 192 and a plurality of lower threads 194 separated by a gap 196 that does not include any threads. The gap 196 provides a feature that allows the vertical position of the adaptor stud 172 to be controlled and adjusted within the adaptor bore 166, as will be described in further detail below. A height of the gap 196 may be selected to control an amount of adjustment of the adaptor stud 172.

The adaptor hub 170 includes a hub chamber 200 that receives the latch mechanism 174 and the ram post 114 (shown in FIG. 1) of the terminator ram 112. In the illustrated embodiment, the hub chamber 200 is progressively stepped inward such that the hub chamber 200 includes a plurality of horizontal surfaces and a plurality of vertical surfaces. The adaptor hub 170 includes a post 202 extending from a bottom of the adaptor hub 170. When the adaptor hub 170 is coupled to the adaptor stud 172, the post 202 is received in the internal bore 184 to secure the adaptor hub 170 to the adaptor stud 172. The post 202 is also received in openings through the height adjustment washer 186 and the washer 190. Optionally, the post 202 may be threaded such that the adaptor hub 170 may be threadably coupled to the adaptor stud 172. The post 202 may be secured to the adaptor stud 172 using alternative means in alternative embodiments. For example, the post 202 may be secured within the internal bore 184 by an interference fit. Adhesive or other fasteners may be used to secure the post 202 within the internal bore 184. In other alternative embodiments, latches or other features may be coupled to the adaptor hub 170 and/or the adaptor stud 172 to secure the adaptor hub 170 to the adaptor stud 172.

The calibration device 178 is secured to the adaptor hub 170 using set screws 204. The calibration device 178 has a generally circular shape with an opening 206 therethrough. The calibration device 178 and the adaptor hub 170 together define the crimp height adjustment mechanism 153. A portion of the adaptor hub 170 extends through the opening 206. In an exemplary embodiment, the calibration device 178 constitutes a dial that may be rotated to simultaneously rotate the adaptor hub 170. The height or vertical position of the ram adaptor 160 with respect to the applicator ram 150 may be precisely controlled by rotating the calibration device 178.

In an exemplary embodiment, when assembled, rotation of the calibration device 178 causes rotation of the adaptor hub 170, which also rotates the adaptor stud 172 to adjust the relative position of the ram adaptor 160 with respect to the applicator ram 150. The calibration device 178 includes markings or indicators 210 along an outer perimeter 212 of the calibration device 178. The indicators 210 provide a visual indication of the position of the calibration device 178 with respect to the applicator ram 150. The calibration device 178 has a large diameter, which may be approximately equal to the size of the top 162 of the applicator ram 150. Having such a large diameter allows the indicators 210 to be spread out around the outer perimeter 212, which allows for good visibility of the indicators 210 and easier fine crimp height adjustment.

The rotational position of the calibration device 178 with respect to the applicator ram 150 may be changed to control a relative position of the adaptor hub 170 with respect to the ram body 163. The calibration device 178 is incrementally dialed to control a threaded position of the adaptor stud 172 with respect to the ram body 163 because rotation of the calibration device 178 and the adaptor hub 170 causes rotation of the adaptor stud 172. In an exemplary embodiment, rotation of the calibration device 178 may be controlled incrementally using a pin 214 that is spring loaded against the bottom 208 of the calibration device 178. The pin 214 includes tip 216 that is received in the teeth on the bottom 208 of the calibration device 178. The pin 214 may ensure incremental movement of the calibration device 178 by ensuring the calibration device 178 stops at incremental or predetermined locations with respect to the tip 216. In an exemplary embodiment, the calibration device 178 may be rotated at 0.1 mm increments, with the pin 214 controlling the stepping or incremental movement of the calibration device 178. An audible and/or tactile click may be heard and/or felt as the calibration device 178 is rotated, which is caused by the engagement of the pin 214 with the calibration device 178.

The latch mechanism 174 is slidably received in the hub chamber 200. The latch mechanism 174 includes a base 220 and a lever 222 extending from the base 220. The latch mechanism 174 is received in the hub chamber 200 such that the base 220 rests upon a support surface 224 defined by one of the horizontal surfaces of the hub chamber 200. The base 220 is slidable in a horizontal direction along the support surface 224. The vertical surfaces of the hub chamber 200 define stops for movement of the latch mechanism 174 within the hub chamber 200.

In an exemplary embodiment, the adaptor hub 170 includes pockets 226 (shown in phantom in FIG. 2) that receives springs 228. The pockets 226 open to the hub chamber 200. The base 220 includes biasing surfaces 230 that face the springs 228. The springs 228 engage the biasing surfaces 230 and press against the biasing surfaces 230 to hold the latch mechanism 174 in latched position (shown in FIG. 3). As such, the latch mechanism 174 is spring loaded and normally held in the latched position. The latch mechanism 174 may be moved to an unlatched position (shown in FIG. 4) by pushing the lever 222 against the spring bias of the springs 228.

The latch retainer 176 holds the latch mechanism 174 within the hub chamber 200. In the illustrated embodiment, the latch retainer 176 is secured to the adaptor hub 170 using fasteners 232. The latch mechanism 174 is slidable within the hub chamber 200 between the latch retainer 176 and the support surface 224 of the hub chamber 200.

The base 220 includes an opening 234 therethrough. The opening 234 receives the ram post 114 (shown in FIG. 1) therethrough. The base 220 engages the ram post 114 after the ram post 114 is loaded into the hub chamber 200. The base 220 holds the ram post 114 in the hub chamber 200 when the latch mechanism 174 is in the latched position.

Figure 3:
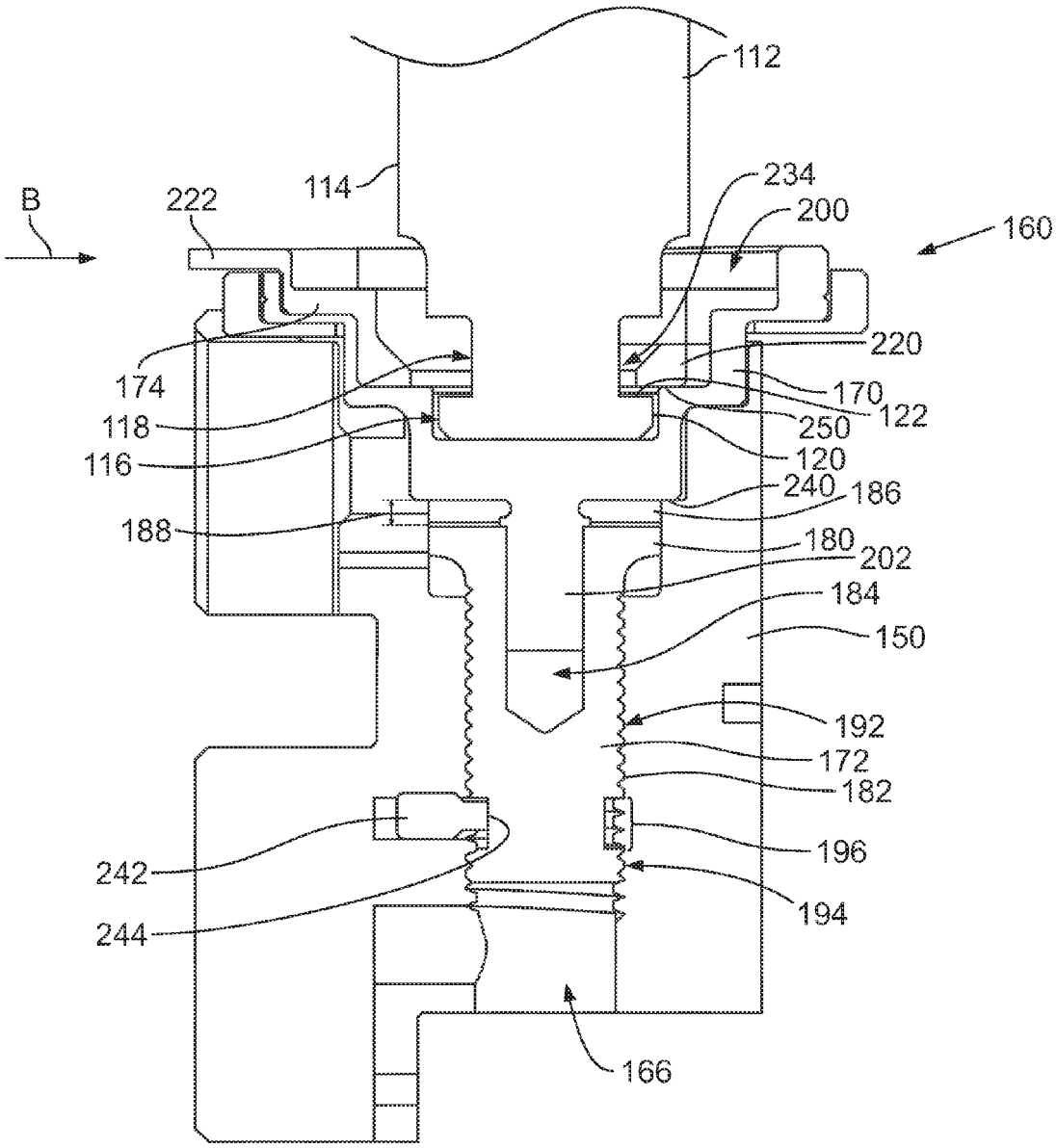
FIG. 3 is a cross-sectional view of the applicator ram and the ram adaptor illustrating the ram adaptor in a latched position.

FIG. 3 is a cross-sectional view of the applicator ram 150 and the ram adapter 160. During assembly, the ram adaptor 160 is assembled and then loaded into the adaptor bore 166 of the applicator ram 150. During assembly of the ram adaptor 160, the adaptor hub 170 is coupled to the adaptor stud 172 by loading the post 202 into the internal bore 184. The height adjustment washer 186 is held between the head 180 and a bottom 240 of the adaptor hub 170. The thickness or height 188 of the height adjustment washer 186 controls the distance or spacing between the bottom 240 and the head 180. The height adjustment washer 186 illustrated in FIG. 3 has a height 188 that is relatively short. Other height adjustment washers within the family may be taller, for example two or three times taller, than the height adjustment washer 186 shown in FIG. 3. Using height adjustment washers that are thicker would increase the spacing between the bottom 240 and the head 180. Such increase in spacing would position the applicator ram 150 vertically downward with respect to the adaptor hub 170 by a distance equal to the additional thickness or height of the height adjustment washer. The crimp tooling 106 (shown in FIG. 1) would similarly be positioned further downward, or closer to the anvil 102 (shown in FIG. 1) which would decrease the crimp height.

Once the ram adaptor 160 is assembled, the ram adaptor 160 is loaded into the adaptor bore 166. The shaft 182 is threadably coupled to the threads of the adaptor bore 166. A set screw 242 is coupled to the applicator ram 150. An end 244 of the set screw 242 extends into the adaptor bore 166 and engages the shaft 182 of the adaptor stud 172. The end 244 is received in the gap 196 between the upper and lower threads 192, 194. The gap 196 is thicker than the set screw 242 to allow the adaptor stud 172 to move longitudinally within the adaptor bore 166 (e.g., vertically within the adaptor bore 166). The height of the gap 196 defines the range of motion of the adaptor stud 172 within the adaptor bore 166.

Rotation of the ram adaptor 160 causes relative movement between the ram adaptor 160 and the applicator ram 150. The adaptor stud 172 may be moved within the adaptor bore 166 until the set screw 242 tops out against the upper threads 192 or bottoms out against the lower threads 194. In the illustrated embodiment, the ram adaptor 160 range of motion of approximately 360° from the set screw 242 topping out against the upper threads 192 and then bottoming out against the lower threads 194. In an exemplary embodiment, 360° of rotation equates to approximately 1.5 mm of travel for the ram adaptor 160 with respect to the applicator ram 150. The ram adaptor 160 may have more travel in alternative embodiments, such as by having a wider gap 196.

During assembly, the terminator ram 112 is plugged into the ram adaptor 160 to couple the applicator ram 150 to the terminator ram 112. The end portion 116 of the ram post 114 is received in the hub chamber 200. The hub chamber 200 includes an upper chamber 246 and a lower chamber 248. The latch mechanism 174 separates the hub chamber 200 into the upper chamber 246 and the lower chamber 248. The flange 120 is received in the lower chamber 248 and captured below the latch mechanism 174. The latch mechanism 174 latches onto the ram post 114 to secure the ram post 114 within the ram adaptor 160. In the latched position, the opening 234 in the base 220 is mis-aligned, or offset, with respect to the flange 120 of the ram post 114. The base 220 of the latch mechanism 174 is received in the post cavity 118. The latch mechanism 174 secures the ram post 114 within the ram adaptor 160 by capturing the flange 120 below the base 220. The shoulder 122 of the flange 120 is captured below the base 220. The base 220 has a catch surface 250 that is positioned vertically above a portion of the flange 120. Removal of the ram post 114 from the ram adaptor 160 is restricted by the latch mechanism 174.

During assembly, the ram post 114 may be jammed into the hub chamber 200 without actuating the lever 222. As the ram post 114 engages the base 220, the latch mechanism 174 may automatically slide to the unlatched position, in which the opening 234 is aligned with the ram post 114. The walls of the base 220 surrounding the opening 234 are ramped to operate as a wedge to force the latch mechanism 174 to shift laterally as the ram post 114 is jammed into the opening 234. Once the flange 120 clears the base 220, the latch mechanism 174 may be automatically returned to the latched position by the springs 228 (shown in FIG. 2).

Figure 4:
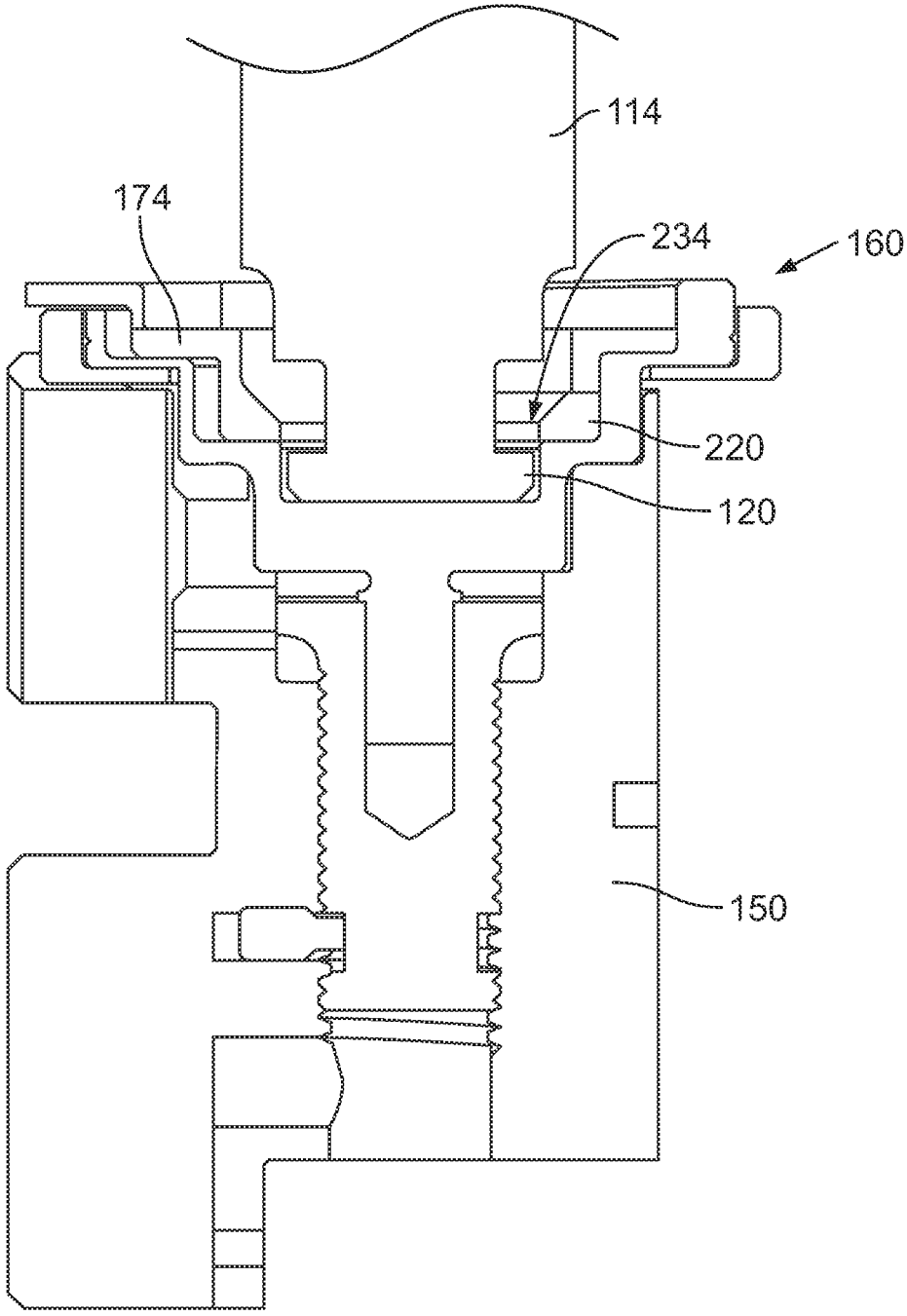
FIG. 4 is a cross-sectional view of the applicator ram and the ram adaptor illustrating the ram adaptor in an unlatched position.

The latch mechanism 174 is movable between a latched positioned (shown in FIG. 3) and an unlatched position (shown in FIG. 4). The latch mechanism 174 is spring loaded and normally in the latched position. The spring force may be overcome by pressing the lever 222 and moving the latch mechanism 174 to the unlatched position. The latch mechanism 174 may be slid in a sliding direction perpendicular to the ram post 114, shown by the arrow B, to the unlatched position. In the illustrated embodiment, the sliding direction is generally in the horizontal direction. The lever 222 is accessible from an exterior of the adaptor hub 170. The lever 222 is actuated to move the latch mechanism 174 from the latched position to the unlatched position. When the lever 222 is released, the springs 228 force the latch mechanism 174 to return the latched position. In the latched position, the ram post 114 is locked in the hub chamber 200.

During operation, movement of the terminator ram 112 along the termination stroke causes the applicator ram 150 to move along the crimp stroke. For example, as the terminator ram 112 is lifted upward, the shoulder 122 engages the bottom of the base 220 and lifts the ram adaptor 160 and applicator ram 150. During the downward portion of the termination stroke, the ram post 114 forces the ram adaptor 160 and the applicator ram 150 in a downward direction.

FIG. 4 is a cross-sectional view of the ram adaptor 160 and the applicator ram 150 illustrating the latch mechanism 174 in the unlatched position. In the unlatched position, the opening 234 in the base 220 is aligned with the flange 120 of the ram post 114. The ram post 114 may pass through the opening 234 to uncouple the ram adaptor 160 and the applicator ram 150 from the ram post 114. The latch mechanism 174 is moved to the unlatched position by pressing the lever 222 and forcing the latch mechanism 174 to slide horizontally to the unlatched position.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An applicator ram comprising:

a ram body configured to hold crimp tooling; and a ram adaptor coupled to the ram body, the ram adaptor being configured to be coupled to a terminator ram, the ram adaptor comprising:

an adaptor hub having a hub chamber configured to receive a ram post of the terminator ram;

a latch mechanism movably received in the hub chamber, the latch mechanism movable relative to the adaptor hub between a latched position and an unlatched position, the latch mechanism being configured to engage the ram post in the latched position, the latch mechanism allowing the ram post to be released from the hub chamber in the unlatched position; and an adaptor stud extending from the adaptor hub, the adaptor stud being configured to be coupled to the ram body.

2. The ram adaptor of claim 1, wherein the latch mechanism is spring loaded within the hub chamber with the latch mechanism being spring biased to move the latch mechanism to the latched position.

3. The ram adaptor of claim 1, wherein the latch mechanism is movable in a sliding direction substantially perpendicular to the ram post.

4. The ram adaptor of claim 1, wherein the hub chamber has an upper chamber and a lower chamber, the latch mechanism separating the hub chamber into the upper chamber and the lower chamber, the lower chamber being configured to receive an end portion of the ram post, the latch mechanism locking the end portion of the ram post in the lower chamber.

5. The ram adaptor of claim 1, further comprising a latch retainer coupled to the adaptor hub, the latch mechanism being slidable between the latch retainer and a support surface of the adaptor hub.

6. The ram adaptor of claim 1, wherein the latch mechanism includes an opening therethrough, the opening being configured to receive the ram post therethrough, the latch mechanism being shifted from the unlatched position to the latched position in which the opening is misaligned with respect to the ram post such that the latch mechanism blocks the ram post from being removed from the hub chamber.

7. The ram adaptor of claim 1, wherein the latch mechanism comprises a lever accessible from an exterior of the adaptor hub, the lever being actuated to move the latch mechanism from the latched position to the unlatched position.

8. The ram adaptor of claim 1, wherein the adaptor hub includes pockets open to the hub chamber, the pockets receiving springs therein, the latch mechanism having biasing surfaces, the springs engaging the biasing surfaces.

9. The ram adaptor of claim 1, further comprising a calibration device coupled to the adaptor hub, the calibration device controlling a relative position of the adaptor hub with respect to the ram body.

10. The ram adaptor of claim 1, wherein the adaptor stud is threadably coupled to the ram body, the ram adaptor further comprising a calibration device coupled to, and circumferentially surrounding, the adaptor hub, the calibration device being incrementally dialed to control a threaded position of the adaptor stud with respect to the ram body.

11. The ram adaptor of claim 1, further comprising a family of height adjustment washers, each height adjustment washer having a different height, one of the height adjustment washers being positioned between the adaptor hub and the adaptor stud to control a relative position of the adaptor hub with respect to the adaptor stud.

12. The ram adaptor of claim 1, further comprising a height adjustment washer positioned between the adaptor hub and the adaptor stud to control a relative position of the adaptor hub with respect to the adaptor stud.

13. An applicator ram comprising:

a ram body holding a crimp tool; and a ram adaptor coupled to the ram body, the ram adaptor having a spring loaded latch mechanism configured to lock onto a terminator ram post, the latch mechanism slidably movable between a latched position and an unlatched position, the latch mechanism being spring loaded to the latched position, the latch mechanism being configured to engage the terminator ram post in the latched position, the latch mechanism allowing the terminator ram post to be released in the unlatched position.

14. The applicator ram of claim 13, wherein the latch mechanism is movable in a sliding direction substantially perpendicular to the terminator ram post.

15. The applicator ram of claim 13, wherein the latch mechanism includes an opening therethrough, the opening being configured to receive the terminator ram post therethrough, the latch mechanism being shifted from the unlatched position to the latched position in which the opening is misaligned with respect to the ram post such that the latch mechanism blocks the ram post from being removed from the ram adaptor.

16. The applicator ram of claim 13, wherein the ram adaptor includes an adaptor hub that receives the latch mechanism and the terminator ram post, the adaptor hub having pockets receiving springs therein, the latch mechanism having biasing surfaces, the springs engaging the biasing surfaces to force the latch mechanism to the latched position.

17. The applicator ram of claim 13, wherein the ram adaptor includes an adaptor hub that receives the latch mechanism and the terminator ram post, the ram adaptor includes a calibration device coupled to the adaptor hub, the calibration device controlling a relative position of the adaptor hub with respect to the ram body.

18. The applicator ram of claim 13, wherein the ram adaptor includes an adaptor hub that receives the latch mechanism and the terminator ram post, the ram adaptor includes an adaptor stud extending from the adaptor hub, the adaptor stud being threadably coupled to the ram body, the ram adaptor further comprising a calibration device coupled to, and circumferentially surrounding, the adaptor hub, the calibration device being incrementally dialed to control a threaded position of the adaptor stud with respect to the ram body.

19. An applicator comprising:

an anvil positioned within a crimping zone;

an applicator body having a ram chamber, the applicator body positioned proximate to the crimping zone;

an applicator ram movably received in the ram chamber, the applicator ram being driven in the ram chamber by a terminator ram during a crimp stroke, the applicator ram having crimp tooling coupled thereto being driven by the applicator ram along the crimp stroke within the crimping zone toward and away from the anvil, the applicator ram having an adaptor bore extending into the applicator ram; and a ram adaptor coupled to the applicator ram, the ram adaptor being releasably coupled to the terminator ram, the ram adaptor comprising an adaptor stud received in the adaptor bore and coupled to the applicator ram, the ram adaptor comprising an adaptor hub coupled to the ram stud, the ram adaptor comprising a spring loaded latch mechanism received in the adaptor hub, the latch mechanism being configured to lock onto a terminator ram post, the latch mechanism movable relative to the adaptor hub between a latched position and an unlatched position, the latch mechanism being configured to engage the terminator ram post in the latched position, the latch mechanism allowing the terminator ram post to be released in the unlatched position.

20. The applicator of claim 19, wherein the latch mechanism is movable in a sliding direction substantially perpendicular to the terminator ram post.

* * * * *